United States Patent [19]

Lipatov et al.

[11] Patent Number: 4,470,457

[45] Date of Patent: Sep. 11, 1984

[54] DEVICE FOR THE TRANSFER OF PLUGGING AND GROUTING MATERIALS TO, AND THEIR PROCESSING AT, A PRE-SET LEVEL IN A WELL

[75] Inventors: Nikolai K. Lipatov; Gennady V. Patrushev, both of Apatity, Murmanskaya; Ruben A. Tatevosyan, Moscow; Arian M. Yakovlev; Lev A. Tereschenko, both of Leningrad; Boris J. Pyakkonen, Apatity, Murmanskaya, all of U.S.S.R.

[73] Assignee: Proizvodstvennoe Geologicheskoe Obiedinenie Tsentralnykh Raionov "Tsentrgeologiya", Moscow, U.S.S.R.

[21] Appl. No.: 438,869

[22] PCT Filed: Feb. 23, 1981

[86] PCT No.: PCT/SU81/00018

§ 371 Date: Oct. 18, 1982

§ 102(e) Date: Oct. 18, 1982

[87] PCT Pub. No.: WO82/02923

PCT Pub. Date: Sep. 2, 1982

[51] Int. Cl.[3] ..... E21B 33/13

[52] U.S. Cl. ..... 166/168; 166/286; 166/381

[58] Field of Search ..... 166/168, 164, 162, 163, 166/285, 286, 290, 291, 387, 383, 386, 300, 381; 405/261, 235, 233, 260

[56] References Cited

U.S. PATENT DOCUMENTS 2,064,336 12/1936 Bates ..... 166/286

FOREIGN PATENT DOCUMENTS 1232480 10/1960 France ..... 166/285
2500053 8/1982 France ..... 405/260
451835 11/1974 U.S.S.R. .
658262 4/1979 U.S.S.R. .
685808 9/1979 U.S.S.R. .

OTHER PUBLICATIONS

"Technology and Processes for Cementing Wells," S. V. Logvinenko, Moscow, Nedra Publishing House, 1978, pp. 215–224.

"Overhaul of Oil and Gas Wells," V. A. Kharkov, 2nd Edition, Rev. and Supply, Nedra Publishing House, Moscow, 1969, p. 35.

*Primary Examiner*—Ernest R. Purser
*Assistant Examiner*—Hoang C. Dang
*Attorney, Agent, or Firm*—Lilling & Greenspan

[57] ABSTRACT

A device for the transfer of plugging and grouting materials to, and their processing at, a pre-set level in a well comprises a pipe container which is rigidly mechanically connected by means of series installed limiter and cylinder to a drilling string. In the lower part of the pipe container, which is stopped by a plug, is installed a splitter and in the upper part, above waterproofing envelopes, is installed for axial movement along the pipe container a main piston having a rod to which is rigidly secured a retainer engageable with the limiter, and an auxiliary piston installed in the cylinder for axial movement therein, which is hydraulically coupled to the drilling string. The retainer is provided on the rod at a distance from the main piston to retain the main piston in its lowermost position immediately above the splitter.

2 Claims, 3 Drawing Figures

DEVICE FOR THE TRANSFER OF PLUGGING AND GROUTING MATERIALS TO, AND THEIR PROCESSING AT, A PRE-SET LEVEL IN A WELL

FIELD OF THE INVENTION

The invention relates to equipment for drilling wells, and more particularly, to devices for the transfer of plugging and grouting materials to, and their processing at, a pre-set level in a well.

BACKGROUND OF THE INVENTION

Abandoning plugging plays an important part in providing an isolating complex for a well which shall exhibit an absolute durability. Only in such a case can a reliable protection of the environment be provided against penetration of biologically contaminated media from the surface into hydrodynamically open levels and therefrom to the surface of buried industrial wastes and toxic gases, radioactive products of underground nuclear tests and also against seismic consequences caused by changes in the strain state of rock masses.

Similar requirements are imposed on insulating complexes of separating bridges.

In making artificial well bottoms a mechanical stability of the complex against the action of a drilling tool should be provided.

DESCRIPTION OF THE PRIOR ART

Several types of devices for the transfer of plugging and grouting materials to, and their processing at, a pre-set level in a well for performing the abandoning plugging, making separating bridges and forming artificial well bottoms are generally known in the art.

The most widespread are devices for injecting grouting or plugging mixes, prepared directly at the well, into the well or to its pre-set level. These devices comprise a mix preparing machine and a grouting unit placed at the well head and an injection pipeline lowered into the well to the level to be plugged (cf. S. V. Logvinenko, Equipment and Processes for Grouting Wells, Moscow, Nedra Publicashing House (in Russian), 1978, pp. 215–224). This equipment is unwieldy and low-productive.

The need to force-through the plugging and grouting material makes it necessary to prepare liquid mixes which are capable of being conveyed through a pipeline of the device which is associated with considerable losses of expensive and difficult to obtain binders.

In addition, high quality of the isolating complex thus provided cannot be achieved, especially because it is not possible to consolidate the sealing system so that the sealing system may be washed-off, and an artificial well bottom may be broken, thus causing emergency situation.

More convenient for operation is a device for the transfer of plugging an grouting materials to, and their processing at, a pre-set level of a well, comprising a pipe container accommodating in the lower part thereof a pivotal valve, the container being coupled to the drilling string and filled with a liquid plugging mix (cf. V. A. Khar'kov, Overhaul of Oil and Gas Wells, (in Russian), Moscow, Nedra Publishing House, 1969, p. 35).

Owing to the use of a valve, this device can only be used for liquid plugging and grouting materials and it is unsuitable for paste-like and pulverulent materials, in which case the sealing system is of poor quality.

A device for the transfer of plugging and grouting materials to, and their processing at, a pre-set level in a well has recently come into use, which comprises a transfer core pipe conveyor mechanically coupled to a drilling string by means of a limiter device for sliding of the pipe container along the string.

The pipe container is filled with a material to be processed in waterproof envelopes and has in the lower part a splitter knife, the lower part being plugged, and the top part of the pipe container accommodating an axially movable main piston having a rod to which is rigidly secured a retainer engageable with the limiter device.

The piston is hydraulically coupled to the drilling string and is disposed over the waterproof envelopes (cf. USSR Inventor's Certificate No. 658262, Cl. E 21 B 33/138, Official Bulletin No. 15, 1979).

This prior art device does not, however, permit durable sealing systems to be formed at pre-set levels in the well.

This is due to the fact that, owing to an inadequate mechanical action, the material forced out from the pipe container is poorly mixed with a hardener which can be only water.

The use of other hardeners such as polymers is practically impossible in view of both poor mixing and uncotrollable contact of the plugging material in the pipe container with both displacing liquid fed from the drilling string and with the formation fluid present in the well.

In addition, the quality of sealing systems is also affected because the required density of the sealing material cannot be achieved in view of an inadequate load on the processed material and inadequate pressure applied thereto until it completely hardens. This is due to the absence of locking of the piston in the limit position within the pipe container.

The material is only forced out during the translationary movement of the core pipe container which results in the envelopes containing the material being processes being jammed in the pipe container thus hampering an adequately compact placing of the material in the well.

The sliding coupling of the core pipe to the drilling string does not make it possible to impart to the pipe container vibratory or other actions to improve the mobility of the contents of the pipe container and density of the material when placed in the well shaft.

The sliding surface of the container pipe engaging the drilling string is exposed and subjected to external factors thus imposing limitations on the size of the device and frequently resulting in emergency situations.

SUMMARY OF THE INVENTION

The invention is based on the problem of providing a device for the transfer of plugging and grouting materials to, and their processing at, a pre-set level in a well, wherein a new structural arrangement of the piston and its position within the core pipe container provide for desired mechanical actions to be imparted to the material forced out of the pipe conveyor with an appropriate load being applied to the processed material and a pressure being maintained until the material completely hardens so as to form reliable and durable sealing systems in abandoning plugging, forming separating bridges and artificial well bottoms, the hardener being in the form of any substance appropriate for the purpose.

This is accomplished by a device for the transfer of plugging and grouting materials to, and their processing at, a pre-set level in a well, comprising a transfer core pipe container which is mechanically coupled by means of a limiter to a drilling string and which is filled with the material being processed in waterproof envelopes. The pipe container has a splitter in its lower part closed by a plug, and provided in its upper part is a main piston with a rod to which is rigidly secured a retainer engageable with the limiter rigidly connected to the pipe container, the main piston being movable along the pipe container, disposed above the waterproof envelopes and hydraulically coupled to the drilling string. According to the invention, the device comprises a cylinder which is provided between the limiter and the drilling string and which is mechanically coupled to the drilling string and rigidly connected to the limiter, and an auxiliary piston which is rigidly secured to the rod of the main piston, installed for axial movement in the cylinder and hydraulically coupled to the drilling string, the retainer being installed on the rod at a distance from the main piston to retain the main piston in the lowermost position immediately above the splitter.

The device is preferably provided with a hydraulic vibrator for hydraulically coupling the auxiliary piston to the drilling string, the hydraulic vibrator being rigidly installed between the cylinder and the drlling string.

This structural embodiment of the device for the transfer of plugging and grouting materials to, and their processing at, a pre-set level in a well according to the invention provides for reliable and durable sealing systems in abandoning plugging, forming separating bridges and artificial well bottoms.

BRIEF DESCRIPTION OF THE DRAWINGS

The invention will now be described with reference to a specific embodiment illustrated in the accompanying drawings, in which.

DETAILED DESCRIPTION OF THE INVENTION

Figure 1:
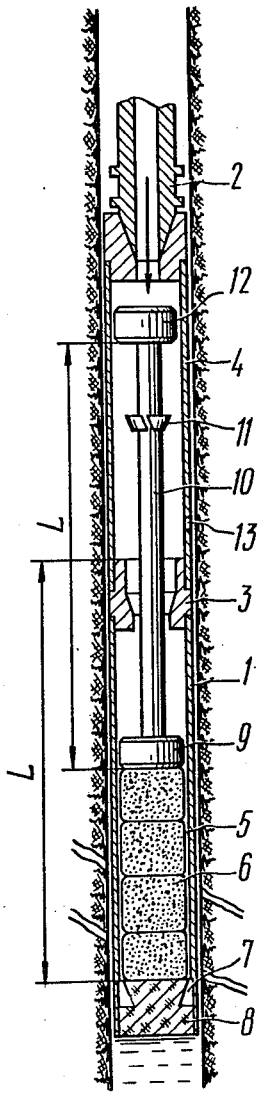
FIG. 1 is a longitudinal section of a device for the transfer of plugging and grouting materials to, and their processing at, a pre-set level in a well according to the invention (in the transfer position)

A device for the transfer of plugging and grouting materials to, and their processing at, a pre-set level in a well comprises a core pipe container 1 (FIG. 1) which is mechanically coupled to a drilling string 2 by means of a limiter 3 and a cylinder 4. The limiter 3 is rigidly connected to the pipe container 1, and the cylinder 4 is installed between the limiter 3 and the drilling string 2 and is rigidly secured therebetween.

The pipe container 1 accommodates waterproof envelopes 5 containing a material 6 to be processed.

A splitter 7 in the form of knives and a stopping plug 8 is provided in the lower part of the pipe container 1.

Above the waterproof envelopes 5 containing the material 6 there are provided, in the pipe container 1, a main piston 9 having a rod 10 to which is rigidly secured a retainer 11 engageable with the limiter 3, and an auxiliary piston 12.

The auxiliary piston is installed in the cylinder 4 for axially moving therealong, the auxiliary piston 12 being hydraulically coupled to the drilling string 2.

The cylinder 4 may have an opening 13.

Figure 2:
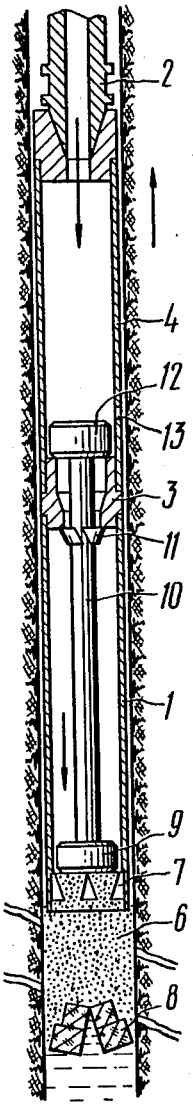
FIG. 2 is a longitudinal section of a device for the transfer of plugging and grouting materials to, and their processing at, a pre-set level in a well according to the invention, in the position after the processing.

The retainer 11 is provided on the rod 10 at a distance from the main piston 9 providing for retaining the main piston in the lowermost position (FIG. 2) immediately above the splitter 7.

Figure 3:
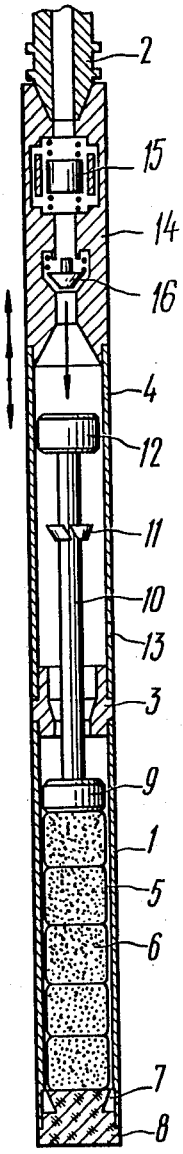
FIG. 3 is a longitudinal section of a device according to the invention having a hydraulic vibrator, in the transfer position.

FIG. 3 shows the device according to the invention having a hydraulic vibrator 14 comprising a working piston 15 and a valve 16.

The hydraulic vibrator is rigidly installed between the cylinder 4 and the drilling string 2 and provides for a hydraulic coupling between the auxiliary piston 12 and the drilling string 2.

The device for the transfer of plugging and grouting materials to, and their processing at, a pre-set level in a well functions in the following manner.

The material 6 packed in the waterproof envelopes 5 (FIG. 1) is placed into the pipe container 1 screwed-off the drilling string 2 with the upper position of the main piston 9. Then the splitter 7 and the plug 8 are installed in the lower part of the core pipe container 1. The pipe container 1 is then screwed together with the drilling string 2 and lowered into the well to the level at whch the plugging operation is to be conducted.

When the device is installed in the well, a displacing fluid is injected through the passage of the drilling string 2 into the interior of the cylinder 4, and the fluid acting on the piston 12 and rod 10 and on the piston 9 forces the contents of the pipe container 1 out into the well.

After the plug 8 and a certain quantity of the material 6 are forced out, the pressure of the displacing fluid is monitored. As soon as the pressure rises abruptly, the drilling string 2 is caused to rotate at a low speed and is lifted at a rate ensuring a constant pressure.

In certain applications it can be made with reciprocations of the drilling tool at a frequency between 0.1–10 Hz and with an amplitude of up to 40 mm. The reciprocations substantially facilitate the emergence of the material 6 from the core pipe container 1, its placing and compaction in the well, and rotation improves the conditions for cutting the waterproof envelopes 5 by the splitter 7 and guiding of the material 6 to this well walls.

After the piston 12 reaches its lowermost position (FIG. 2), the displacing fluid starts emerging through the opening 13 into the annulus, and the fluid pressure abruptly drops thus indicating to the end of displacement of the material 6.

The rotation and reciprocations are then stopped, but the device is left on the well bottom and is subjected to a pressure in such a manner as to apply a desired pressure to the material. The uniformity of pressure application to the material is ensured by the retainer 11 retaining the piston 9 in its lowermost position immediately above the splitter 7.

The device is left on the well bottom for a time needed for the sealing system to harden and is then rotated to strip it off the well bottom and lifted from the well. After cleaning and lubricating the core pipe container 1, the process may be repeated.

In forming artificial well bottoms, the device according to the invention makes it possible to transfer and install hard-rock cores with a very high quality of their cementing.

Industrial Applicability

The invention may be used for forming sealing systems in abandoning plugging of wells after their functional use is completed, for forming separating bridges for isolating water-bearing formations, and for forming artificial well bottoms in drilling multiple shaft wells.

We claim:

1. A device for the transfer of plugging and grouting materials to, and their processing at, a preset level of a well, comprising a transfer core pipe container mechanically coupled by means of a limiter to a drilling string and filled with a material to be processed in waterproof envelopes, the pipe container having a splitter in its lower part stopped by a plug and provided in an upper part with a main piston axially movable in the pipe container and having a rod to which is rigidly secured a retainer engageable with the limiter rigidly connected to the pipe container, the main piston being installed above the waterproof envelopes and hydraulically coupled to the drilling string, wherein the improvement comprises a cylinder installed between the limiter and the drilling string, mechanically coupled to the drilling string and rigidly connected to the limiter; and an auxiliary piston rigidly secured to the rod of the main piston, installed in the cylinder for axial movement therein and hydraulically coupled to the drilling string; and the retainer being installed on the rod at a distance from the main piston to retain the main piston in a lowermost position immediately above the splitter.

2. A device according to claim 1, further comprising a hydraulic vibrator ensuring a hydraulic coupling between the auxiliary piston and the drilling string, the vibrator being rigidly installed between the cylinder and the drilling string.

* * * * *